United States Patent [19]

Bonerb et al.

[11] 4,449,646

[45] May 22, 1984

[54] BIN FOR STORING AND DISCHARGING FREE-FLOWING GRANULAR MATERIAL

[76] Inventors: Timothy C. Bonerb; Vincent C. Bonerb, both of P.O. Box 1997, Buffalo, N.Y. 14219

[21] Appl. No.: 307,089

[22] Filed: Sep. 30, 1981

Related U.S. Application Data

[63] Continuation-in-part of Ser. No. 257,604, Apr. 27, 1981.

[51] Int. Cl.[3] ..... B65D 88/62

[52] U.S. Cl. ..... 222/95; 222/105; 222/386.5; 52/197

[58] Field of Search ..... 222/105, 386.5, 95, 222/203, 200; 52/197

[56] References Cited

U.S. PATENT DOCUMENTS 2,956,839 10/1960 Hermanns ..... 222/386.5
4,306,668 12/1981 Love ..... 222/105

FOREIGN PATENT DOCUMENTS 2705689 8/1978 Fed. Rep. of Germany ..... 222/203
1089874 11/1967 United Kingdom ..... 222/386.5
1144162 3/1969 United Kingdom ..... 52/197

*Primary Examiner*—Joseph J. Rolla
*Assistant Examiner*—Frederick R. Mandren
*Attorney, Agent, or Firm*—Bernard, Rothwell & Brown

[57] ABSTRACT

A bin for storing and discharging free-flowing granular material, such as sugar, has a cup-shaped bag with a dual flexible wall for holding the material and a discharge opening in its bottom resting on a flat floor. Fluid under pressure between the flexible walls causes the inner wall to expand and discharge the material that would otherwise remain after assuming its angle of repose. The upper inner wall of the cup-shaped bag is provided with slack in the flexible wall above the angle of repose, and is anchored at the bottom of its side walls. The bin is also provided with a back-up outside wall.

7 Claims, 6 Drawing Figures

FIG. 4
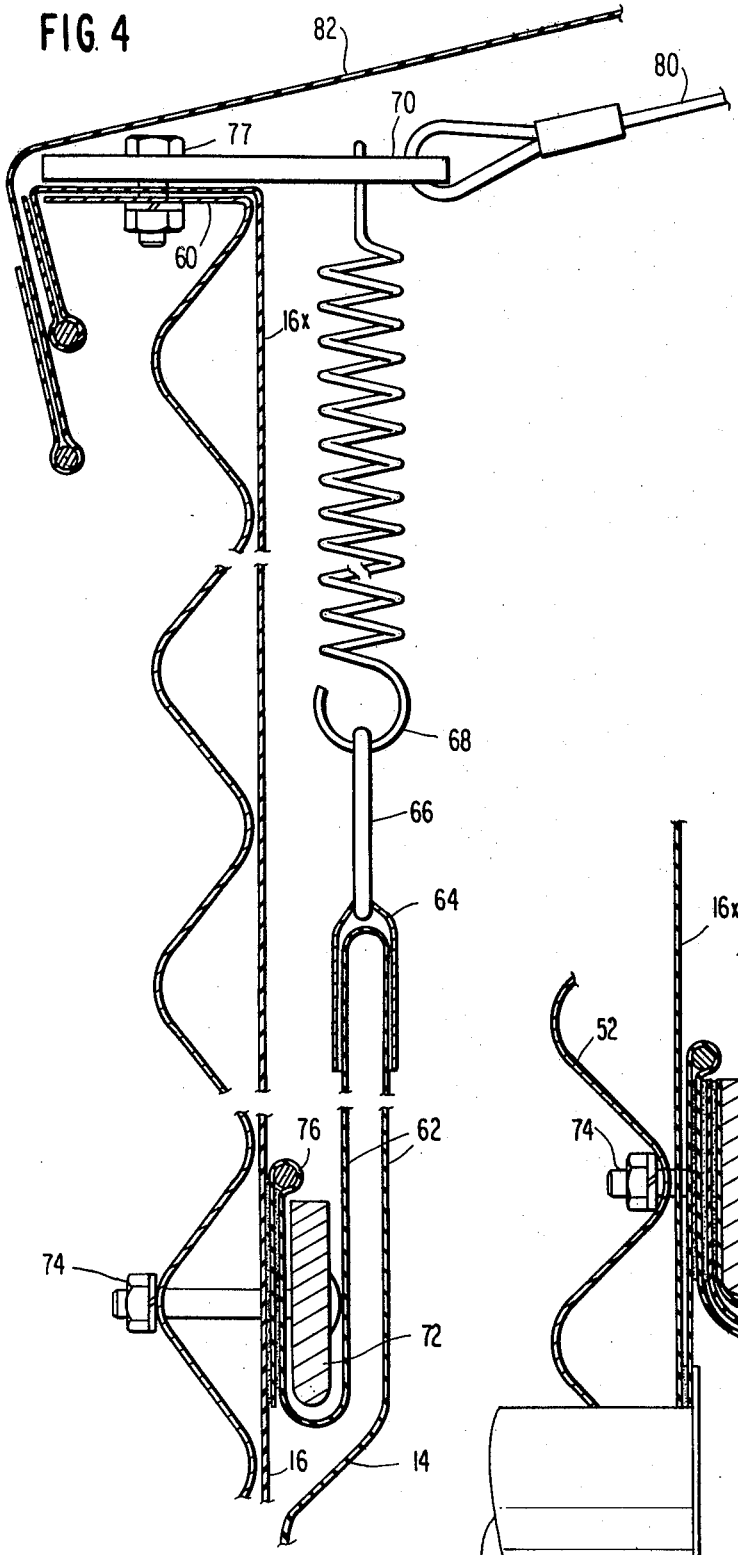
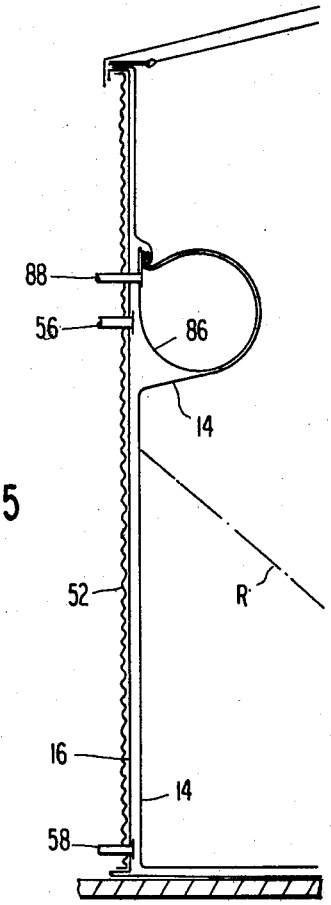
FIG. 5
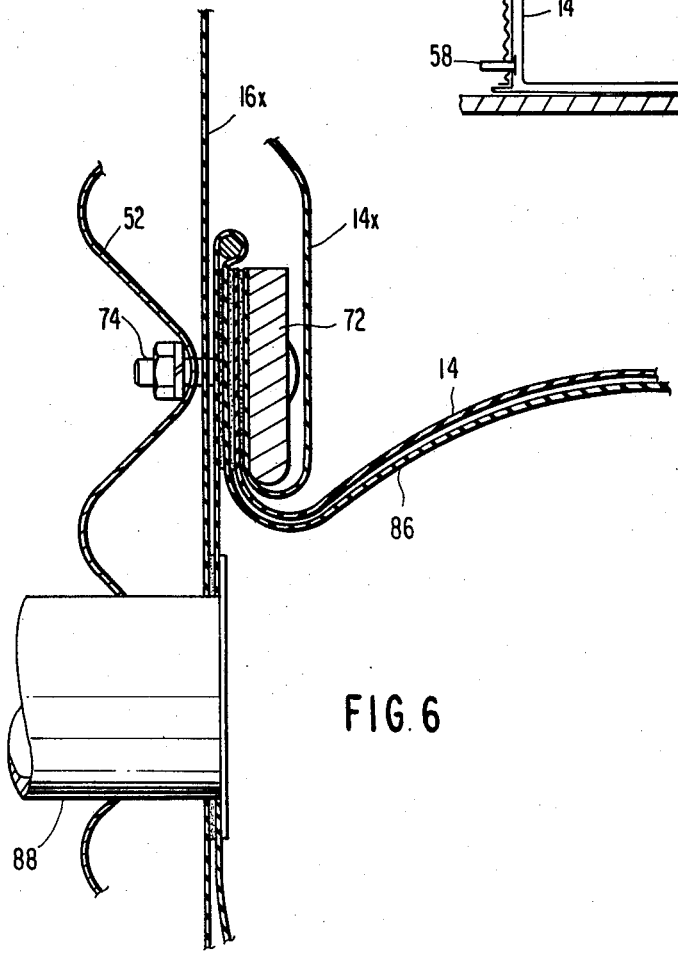
FIG. 6

BIN FOR STORING AND DISCHARGING FREE-FLOWING GRANULAR MATERIAL

CROSS-REFERENCE TO RELATED APPLICATIONS

This is a continuation-in-part of our application Ser. No. 257,604 filed Apr. 27, 1981, titled *BIN FOR FREE FLOWING MATERIAL.*

BACKGROUND

1. Field of the Invention

This invention relates to improvements in flexible wall storage bins with fluid pressure assisted discharge after the material in the bin assumes its angle of repose and particularly to such improvements in connection with supporting, anchoring and providing slack in the flexible wall.

2. Prior Art

Numerous patents in the prior art illustrate utilization of a flexible membrane which is moved by fluid pressure to assist in moving various materials. Examples of such prior art are shown in U.S. Pat. Nos. 2,792,262, 2,956,839, 3,209,894, 3,396,762, and 3,421,663.

In our prior application Ser. No. 257,604, filed Apr. 27, 1981, of which this application is a continuation-in-part, we disclosed the general concept of a flexible cup-shaped dual-walled bag functioning as a storage bin on a flat horizontal surface and utilizing fluid pressure for inflating or moving the bag wall to discharge material after it assumes its angle of repose.

In applying the invention of our prior application to specific applications, namely, large-scale storage of a relatively heavy material such as refined granulated sugar, we encountered a number of problems and have invented a number of additional improvements on our basic concept disclosed in our prior parent application.

SUMMARY OF THE INVENTION

One improvement of this invention is the support and anchoring of the flexible bag containing the material to be stored. Because of the size of the bin a seam at or near the top of the side walls of the bag was desirable. However, when applying fluid pressure to expand the bag with a heavy weight of material in it, the top of the bag wall was under extreme stress, and there was a tendency of the seam to split. We overcame this problem by providing slack in the material of the bag wall above the angle of repose so that the bag may have a headstart on inflation when the fluid pressure is applied. We developed two ways of creating this slack. One way is by a separate inflated annulus, and the other way is by a spring-supported folded wall section.

A further improvement in our basic invention was in providing anchoring of the cup-shaped flexible bag adjacent the edge of its bottom walls. With a large amount of material stored in the bin, there was a tendency of the bin to tip. Anchoring the bag prevents such tipping.

Another improvement is in providing a back-up wall outside the outer wall of the flexible cup-shaped. This outer wall provides some support for side- loading so that the material of the flexible bag need not be so heavy. It additionally provides two further functions, namely, supporting the top of the side walls of the cup-shaped bag and anchoring the bottom of the side walls of the cup-shaped bag to the horizontal floor. The back-up wall, made of corrugated material, also is useful in preventing possible puncture of the bag.

Other further improvements in our basic application are included in the detailed description of the preferred embodiment hereinafter.

DETAILED DESCRIPTION OF THE DRAWINGS

FIG. 4 is a detailed sectional elevation view of a portion of the upper side edge of the bin shown in FIG. 1.

FIG. 5 is a partial sectional elevation view, also partially schematic, illustrating another embodiment of this invention.

FIG. 6 is a partial detailed elevation view of a portion of the embodiment shown in FIG. 5.

DETAILED DESCRIPTION OF THE PREFERRED EMBODIMENTS

Figure 1:
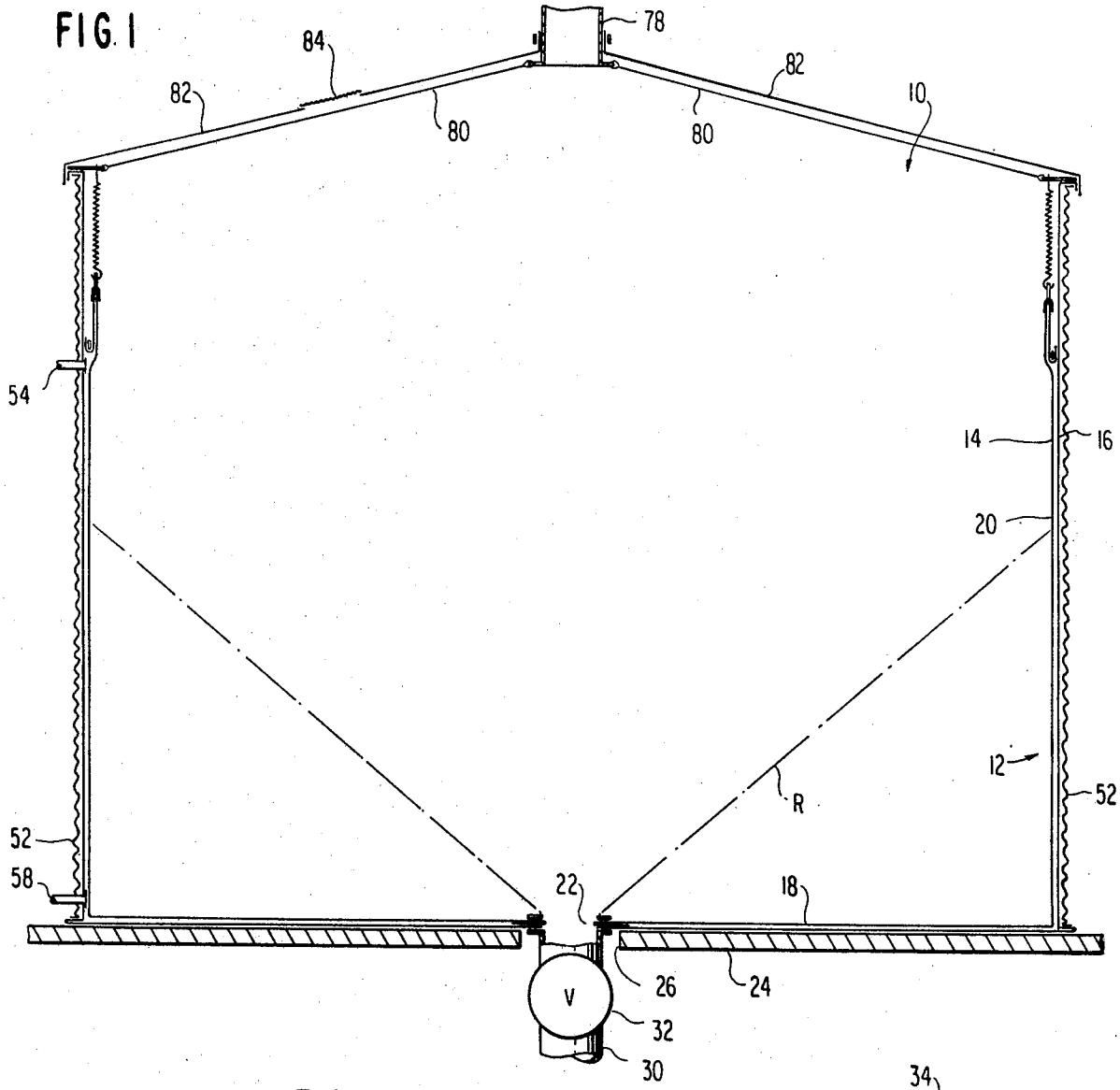
FIG. 1 is a sectional elevation view partially schematic of the storage and discharge bin of this invention.

As shown in FIG. 1 a storage bin 10 for storing and discarging free-flowing granular material is of the type generally disclosed in our prior application, Ser. No. 257,604, filed Apr. 27, 1981. That is, the concept of a dual wall flexible cup-shaped storage member having a bottom discharge and a fluid-assisted discharge when the material assumes an angle of repose is similar in concept to our prior application. A flexible cup-shaped bag 12 having an inner wall 14 and outer wall 16 provides a bottom 18 and side walls 20 of a flexible bin for storing free-flowing granular materials which may be discharged through a discharge opening 22.

The bin rests on a horizontal floor 24 having an opening 26 to accommodate discharge of the materials from the bin. A discharge conduit 30 with any suitable type valve means 32 may be utilized to control the discharge of material from the bin.

The flexible cup-shaped bag is anchored adjacent the discharge opening to a stationary member such as the floor 26 or conduit 30. In the embodiment illustrated in FIG. 2 it is anchored to the conduit 30 by means of a flat annulus 34 and a flange 36 forced together by a nut and bolt 38 to sandwich the ends of the inner and outer walls 14 and 16 adjacent the discharge opening 22. To assist in the anchoring a rope 40 may be secured to the end of the inner wall 14 by an extra loop of material and a heat seal 42, as illustrated in FIG. 2.

Figure 3:
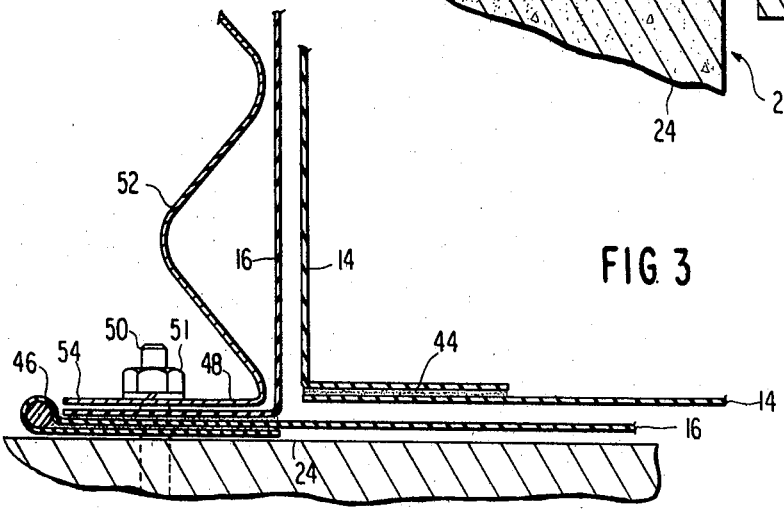
FIG. 3 is a partial sectional elevation view of a portion around the bottom outside edge of the bin shown in FIG. 1.

The outer edge of the bottom portion and lower side wall of the cup-shaped bag and particularly the outer wall thereof are anchored to the floor 24 as shown in detail in FIG. 3. More particularly, the inner wall 14 may be of such size as to require an additional portion of the inner wall to be cemented or heat-sealed to the bottom portion as shown at heat seal 44. The outer wall 16 is looped around a rope 46 and doubled back and heat-sealed at 48. A stud 50 extending from floor 24 has a nut 51 screwed down against a flange 54 of a corrugated side wall 52 sandwiching the bottom edge of outer wall member 16 between the flange 54 and the floor 24.

Figure 2:
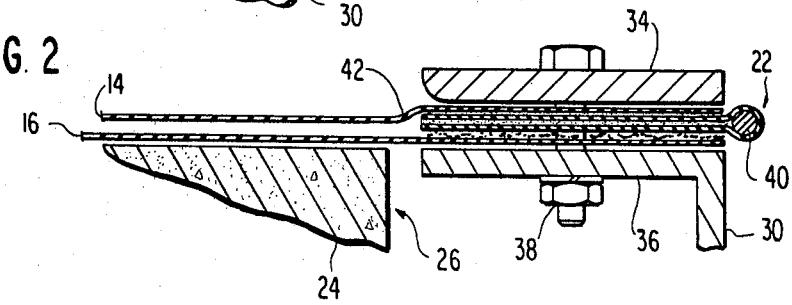
FIG. 2 is a fragmentary sectional elevation view of a portion of the bin around the dicharge opening shown in FIG. 1.

The anchoring arrangement shown in FIGS. 2 and 3 assists in preventing the flexible wall bag from tilting due to large forces of the stored material if it shifts due to loading or unloading. Additionally, wall 52, which may conveniently be corrugated material such as used for grain bins or the like, provides some lateral load support for the outer flexible wall 16 so that the fabric need not be quite as thick and strong. The wall 52 extends upwardly as shown in FIG. 1 and surrounds the outside of the side walls of the flexible cup-shaped bag.

There is provided an opening 54 into the space between the walls 14 and 16 near the top of the side walls of the bag for inflating the bag to assist in discharge of the material therein. There is also an exhaust opening 58 near the bottom of the side walls between the walls of the bag as shown in FIG. 1.

As shown in FIG. 4, the corrugated side wall 52 has a top flange 60 to assist in supporting or holding up the side walls 20. A suitable means for providing slack at the upper portion of the side walls to assist in the discharge includes a slack loop 62 in the upper end of wall 14 which is held up by means of a heat-sealed or cemented loop 64 of fabric material, an O-ring 66 and a coil spring 68 to the O-ring and to a support 70. A hoop 72 is secured to the side wall 52 by a nut and bolt 74 to provide support from the side wall for the outer flexible wall 16. A rope 76 and heat seal arrangement similar to that previously described is also provided as shown in FIG. 4. An extension of the outer flexible wall 16x may extend upwardly over flange 60 and be sandwiched between flange 60 and spring support 70 and secured by nut and bolt arrangement 77.

As shown in FIG. 1, material may be placed into the storage bin via an inlet chute which may be supported from building structure, not shown, and connected to tension cables 80 extending to the spring support 70. A fabric roof 82 of a material similar to that from which the flexible walls of the flexible wall bag are made is provided to cover the top of the bin. The roof has a one-way vent 84 which will allow air to escape from the bin when the bin is being filled, but will not allow dust or particulate material from the granular free-flowing material to escape.

The slack provided by slack loop 62 assists in the inflation of the bag to discharge the flexible free-flowing material from its angle of repose R in FIG. 1. After material is discharged down to the angle of repose R, fluid under pressure such as air is blown into inlet 56 which initially inflates the flexible loop 62 providing a good start for the flexible wall assisted discharge of the material. For further details of the discharge, see our prior application referenced above.

Another and alternative embodiment for providing slack in the inner side wall to assist in the discharge is shown in FIGS. 5 and 6. In those FIGS., where the reference numbers are the same, they indicate the same parts as previously described. FIGS. 5 and 6 show, however, a separate inflatable annulus or tire 86 with a separate inflation opening 88. The tire may be inflated to create a bulge or slack in the inner side wall 14 as shown in FIG. 5. The side wall 14 is secured to the corrugated wall 52 by means of hoop 72 and nut and bolt 74 as shown in FIG. 6.

The invention described has been constructed and utilized for storing and discharging free-flowing granular material, and particularly, refined sugar. The material of the bag has been constructed of a material generally regarded as safe in connection with food products and particularly, a 27-ounce vinyl-type fabric, and only one-half pound per square inch air pressure was utilized with no mechanical means to completely discharge the sugar contents from a bin 12 feet in diameter.

The slack above the angle of repose near the top of the flexible side walls of the cup-shaped bag eliminated undue stress at that point during the initial inflation period. The corrugated wall back-up support allowed the use of a lighter-weight fabric material and prevents puncturing of the flexible bags. The anchoring to the floor at the outer corners of the outer wall prevents tipping or tilting and is conveniently accomplished by a flange of the corrugated wall.

Use of the invention provides a significant advantage in floor loading, as explained in our prior referenced application. It also achieves significant savings in the storing and handling of free-flowing materials, such as granulated sugar.

We claim:

1. A bin for storing and discharging free-flowing granular material, comprising;
   (a) a cup-shaped bag of flexible, fluid-impervious material having two walls capable of holding a fluid under low pressure therebetween, the cup-shaped bag having a bottom and inner and outer side walls.
   (b) a discharge opening extending through the two walls of the cup-shaped bag in the bottom thereof,
   (c) a floor supporting the entire bottom of the cup-shaped bag and having a discharge opening corresponding to the discharge opening in the bottom of the cup-shaped bag,
   (d) means for supporting and holding up the top only of the side walls of the flexible cup-shaped bag,
   (e) means for fixedly anchoring the bottom of the outer side wall only of the cup-shaped bag to the floor,
   (f) means for creating slack in the inner side wall of flexible material of the cup-shaped bag wall near the top thereof and at a position which is always above the maximum height of the top of the free-flowing material after it has assumed its angle of repose, the means creating slack eliminating undue stress in the flexible material forming the inner side wall,
   (g) means for controlling flow of the granular material from the discharge opening,
   (h) means for supplying fluid material between the walls of the cup-shaped bag in the area of the created side wall slack so that when said fluid is supplied after the free-flowing granular material has been discharged down to its angle of repose, the flexible innermost wall of the cup-shaped bag will expand inwardly from the top moving downwardly to completely discharge the contents of the bin, and
   (i) a back-up wall outside the outer side wall of the cup-shaped bag.

2. A bin as defined in claim 1 wherein the means for fixedly anchoring the bottom of the outer side wall of the cup-shaped bag to the floor constitutes the bottom of a back-up wall attached to the floor with a portion of the bag wall therebetween.

3. A bin as defined in claim 1 wherein the means for supporting and holding up the top of the side walls of the cup-shaped bag includes the top of the back-up wall.

4. A bin as defined in claim 1 wherein the means for creating slack in the flexible material comprises a flexible annulus with separate means for inflating the same, the annulus positioned behind at least the inner side wall of the flexible walls of the bag.

5. A bin for storing and discharging free-flowing granular material comprising:

(a) a cup-shaped bag of flexible fluid-impervious material having two walls capable of holding a fluid under low pressure therebetween, the cup-shaped bag having inner and outer bottom and inner and outer side walls, (b) a discharge opening extending through the two walls of the cup-shaped bag at the bottom thereof, (c) a flat, horizontal floor supporting the entire bottom of the cup-shaped bag and having an opening in the bottom of the cup-shaped bag, (d) a rigid back-up wall outside the outer wall of the cup-shaped bag for supporting and holding up the top of the side walls of the cup-shaped bag and for fixedly anchoring the outer bottom wall of the cup-shaped bag to the floor, (e) means for controlling the flow of granular material from the discharging opening, (f) means for supplying and discharging fluid material to and from the space between the walls of the cup-shaped bag so that when such fluid is supplied under low pressure after the free-flowing granular material has been discharged down to its angle of repose, the innermost flexible wall will expand inwardly from the top of the side walls to completely discharge the contents of the bin, and (g) an inflatable flexible annulus above the level of the material in the bin after it has been discharged to its angle of repose, the flexible annulus positioned between the inner and outer side walls so that when inflated it will take the slack out of the inner side wall.

6. A bin as defined in claim 5 further comprising a sealed top covering the bin, the top being of flexible fluid-impervious material having an opening therein for filling the bin and further comprising air-escape filter portions therein to allow air from the bin to escape on filling the bin, while preventing dust from the free-flowing material to escape.

7. A bin for storing and discharging free-flowing granular material, comprising;

(a) a cup-shaped bag of flexible, fluid-impervious material having two walls capable of holding a fluid under low pressure therebetween, the cup-shaped bag having a bottom and side walls, (b) a discharge opening extending through the two walls of the cup-shaped bag in the bottom thereof, (c) a flat horizontal floor supporting the entire bottom of the cup-shaped bag and having a discharge opening in the bottom of the cup-shaped bag, (d) means for supporting and holding up the top of the side walls of the flexible cup-shaped bag, (e) means for fixedly anchoring the bottom of the side walls of the cup-shaped bag to the floor, (f) means for creating slack in the flexible material of the cup-shaped bag wall above a maximum angle of repose of the free-flowing granular material to be stored in the cup-shaped bag as measured from the discharge opening, the means for creating slack including a folded section of the side wall of the bag and a spring means for supporting the folded section, (g) means for controlling flow of the granular material from the discharge opening, and (h) means for supplying fluid material between the walls of the cup-shaped bag in the area of the created side wall slack so that when said fluid is supplied after the free-flowing granular material has been discharged down to its angle of repose, the flexible innermost wall of the cup-shaped bag will expand inwardly from the top moving downwardly to completely discharge the contents of the bin.

* * * * *

UNITED STATES PATENT AND TRADEMARK OFFICE

CERTIFICATE OF CORRECTION

PATENT NO. : 4,449,646

DATED : May 22, 1984

INVENTOR(S) : TIMOTHY C. BONERB, ET AL.

It is certified that error appears in the above-identified patent and that said Letters Patent is hereby corrected as shown below:

Column 3, line 24, after "68" and before "to" insert --hooked--;

, line 34, after "chute" insert --78--.

Signed and Sealed this

*Nineteenth* Day of *February 1985*

[SEAL]

*Attest:*

DONALD J. QUIGG

*Attesting Officer* *Acting Commissioner of Patents and Trademarks*